US006043420A

United States Patent [19]

Arnold

[11] Patent Number: 6,043,420

[45] Date of Patent: Mar. 28, 2000

[54] BASS DRUM PILLOW MUFFLE

[76] Inventor: Richard N. Arnold, 149 Old La. Rd., Springfield, Mass. 01129

[21] Appl. No.: 09/300,050

[22] Filed: Apr. 27, 1999

[51] Int. Cl.[7] ..... G10D 13/02

[52] U.S. Cl. ..... 84/411 M; 84/453

[58] Field of Search ..... 84/400, 411 M, 84/411 R, 453; 181/166, 208

[56] References Cited

U.S. PATENT DOCUMENTS

| | | | |
|---|---|---|---|
| 590,182 | 9/1897 | Bower | 84/411 R |
| 663,853 | 12/1900 | Boulanger | 84/411 M |
| 1,892,223 | 12/1932 | Sansone et al. | 84/411 R |
| 2,198,406 | 4/1940 | Deans et al. | 84/419 |
| 2,572,504 | 10/1951 | Meriwether | 84/411 |
| 3,433,115 | 3/1969 | Kjelstrom | 84/411 R |
| 3,635,119 | 1/1972 | Thompson | 84/411 R |
| 3,951,032 | 4/1976 | LaPorta et al. | 84/419 |
| 4,226,156 | 10/1980 | Hyakutake | 84/1.14 |
| 4,246,825 | 1/1981 | Hodas | 84/415 |
| 4,338,850 | 7/1982 | Payson | 84/411 M |
| 5,233,898 | 8/1993 | Montano | 84/411 M |

FOREIGN PATENT DOCUMENTS 1007596 5/1952 France .

*Primary Examiner*—Brian Sircus
*Assistant Examiner*—Shih-Yun Hsieh
*Attorney, Agent, or Firm*—Ross, Ross & Flavin

[57] ABSTRACT

A pillow muffle is a permanent and integral part of a bass drum and includes a handle provided exteriorly of the bass drum which may be easily activated by the drummer to move the pillow muffle which is disposed interiorly of the bass drum into and out of engagement with one of the drum heads to achieve desired muffling or non-muffling effects.

6 Claims, 3 Drawing Sheets

BASS DRUM PILLOW MUFFLE

BACKGROUND OF THE INVENTION

The invention relates to musical instruments of the percussion type and more particularly to bass drums and means for dampening or muffling the sound produced when the one of the heads of the bass drum is struck.

DESCRIPTION OF RELATED ART

It is a known practice in the musical bass drum art to manually insert a pillow into the interior of the drum and place it against one of the drum heads when it is desired to muffle or dampen sound produced when that drum head is struck.

Such practice requires removal of one of the drum heads in order to permit such insertion when sound muffling is desired and removal of the pillow when sound muffling or dampening effects are not desired.

This constant insertion and removal of the pillow is burdensome and time consuming.

BRIEF SUMMARY OF THE INVENTION

It is a primary purpose of the invention to provide a means for muffling or dampening sound which is a permanent and integral part of the bass drum and which may be readily actuated at the drummer's discretion to produce the desired muffling or dampening effect.

Herein a handle provided exteriorly of the bass drum may be easily activated and moved relative to a slot in the drum shell by the drummer to move a pillow muffle disposed interiorly of the bass drum into and out of engagement with one of the drum heads to achieve the desired muffling or non-muffling effects.

The handle may be spring loaded so as to be easily moved to a use position and automatically returned to a non-use position.

DETAILED DESCRIPTION OF THE INVENTION

Referring first to FIGS. 1–4, a bass drum 10 of standard construction includes the usual open-ended tubular shell 12 having its ends closed by skin-like drum heads 14 and 16 whereby a booming sound is produced when the drum heads are struck by such as a pedal actuated spur 18.

Figure 2:
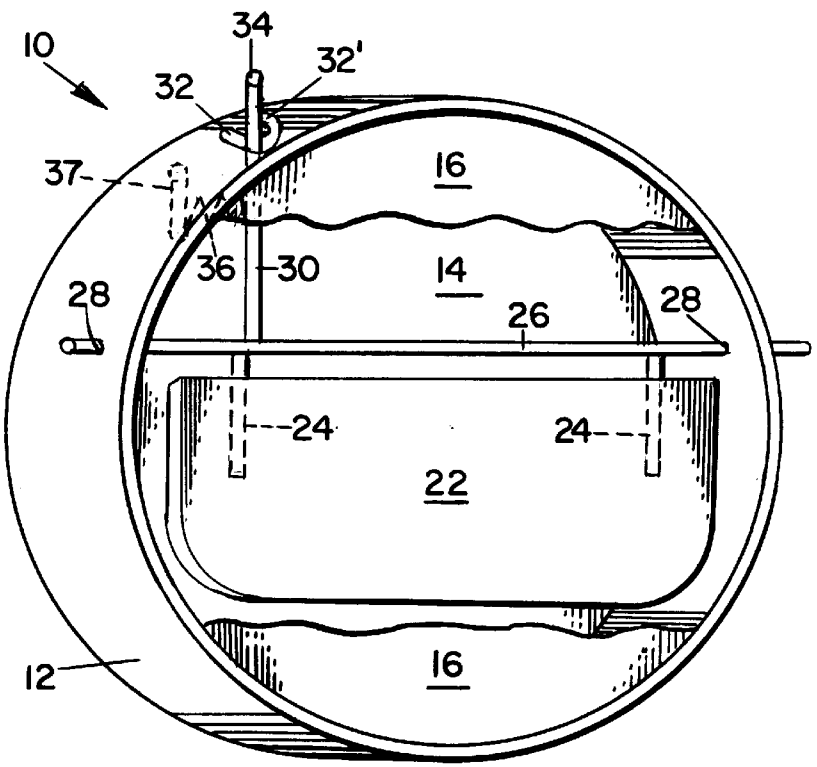
FIG. 2 is a rear perspective view of the bass drum and pillow muffle of FIG. 1, with the rear drum head broken away for clarity of illustration.
Figure 1:
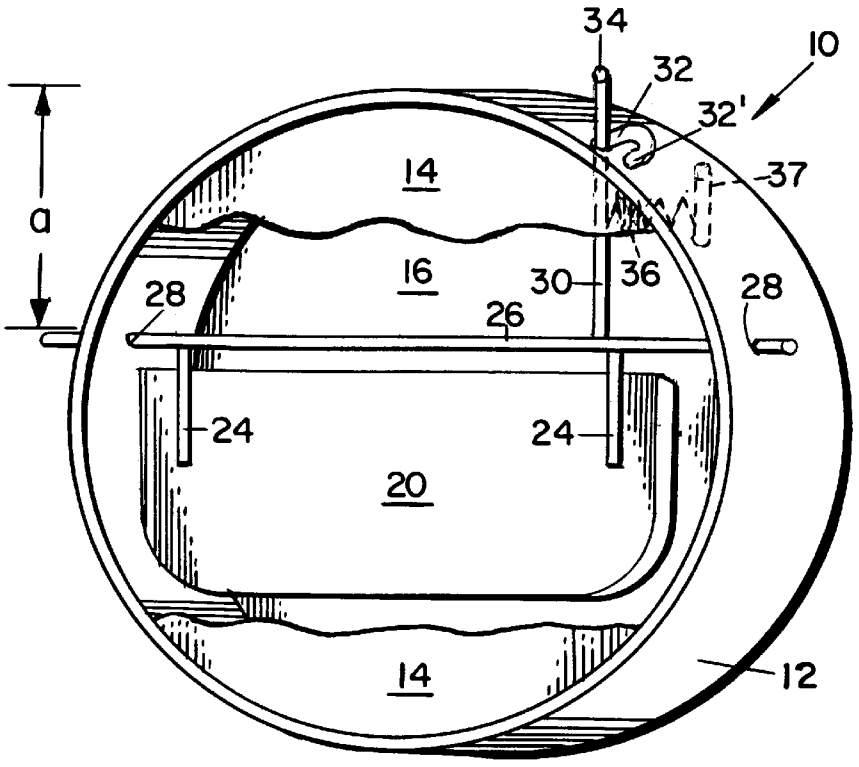
FIG. 1 is a front perspective view of a bass drum incorporating a pillow muffle embodying a preferred form of the invention, with the front drum head broken away for clarity of illustration.

Means is provided for muffling such booming sound and includes an ovoid approximately rectangular muffle pillow 20 disposed interiorly of drum 10 and fixed to the forward face of a complemental, vertically disposed, horizontally extending, ovoid, approximately rectangular mounting plate 22 suspended by a pair of spaced, vertically oriented hangers 24 which are fixed at their upper ends to a rod-like cross bar 26 which extends horizontally across the diameter of shell 12 and is journalled at its opposite ends in openings 28 provided in the shell's upper quadrant, indicated by a in FIG. 1.

A vertically disposed actuating lever 30 is fixed at its lower end to cross bar 26 and extends upwardly from the cross bar and outwardly through a slot 32 in shell 12 to provide a handle 34 which is disposed outwardly of the drum's exterior surface at the drum's upper end so as to be readily grasped by the drummer's hand.

By grasping the handle, actuating lever may be moved forwardly and rearwardly within slot 32 to cause cross bar 26 to pivot relative to shell 12 thereby effecting swinging movement of mounting plate 22 to move muffle pillow 20 into and out of contact with the adjacent drum head 14.

Figure 3:
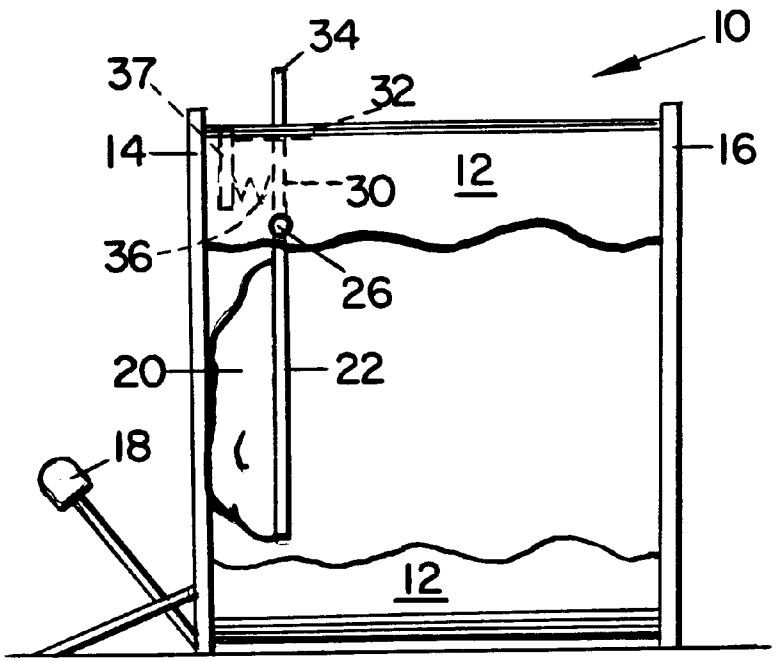
FIG. 3 is a side elevational view of the interior of the bass drum of FIG. 1, with a portion of the drum shell removed and with the pillow muffle in operative position resting against a drum head to muffle any sound produced by the drum when the drum head is struck.
Figure 5:
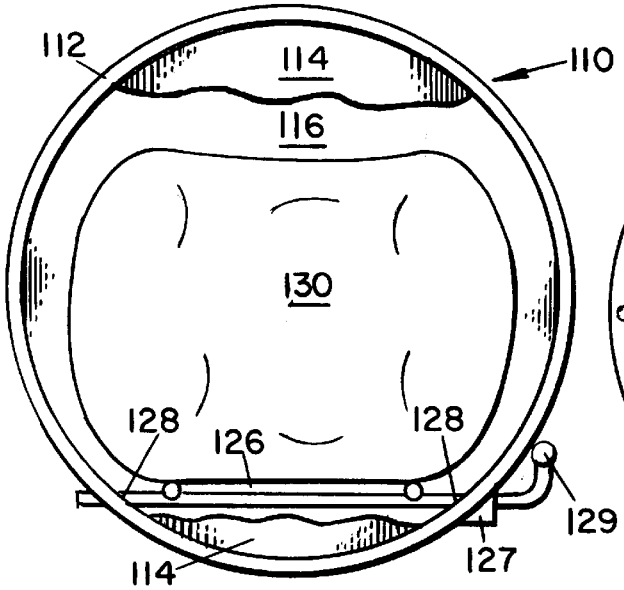
FIG. 5 is a front elevational view of a bass drum incorporating a pillow muffle embodying a modified form of the invention, with the front drum head broken away for clarity of illustration.
Figure 7:
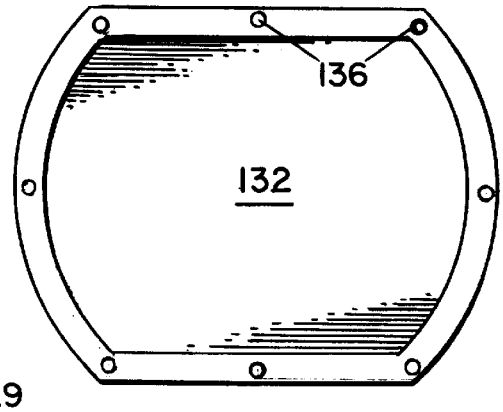
FIG. 7 is a front elevational view of the mounting plate of the pillow muffle of Fig. 5.

When the muffle pillow is in contact with the drum head as shown in FIG. 3, sound is muffled when the drum head is struck by spur 18.

A coil spring 36 extends between a support 37 fixed interiorly of shell 12 and handle 34 to spring load the handle thereby giving more impetus to muffle pillow when it is moved toward the drum head in a striking motion.

An offset 32' is provided in slot 32 for locking handle 34 against movement when the handle is placed therein.

Figure 4:
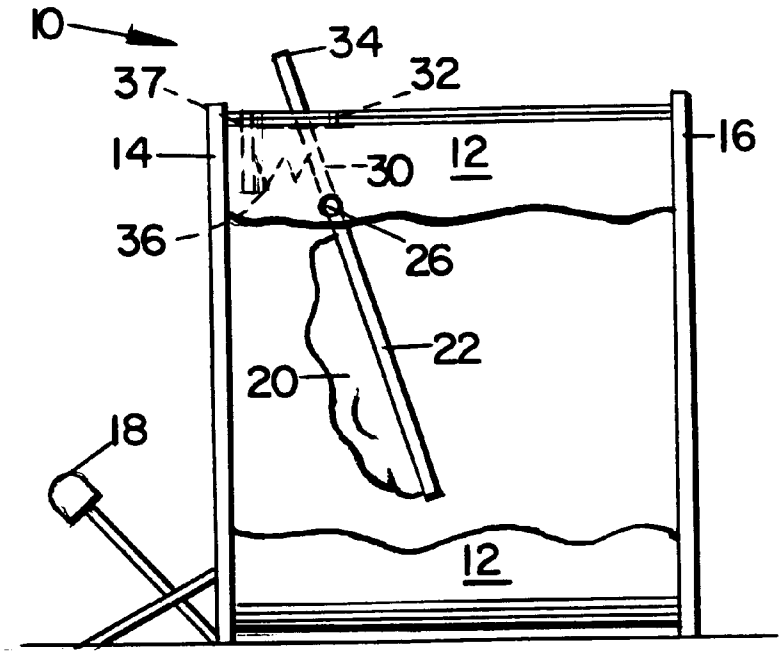
FIG. 4 is a side elevational view similar to FIG. 3 with the pillow muffle in inoperative position spaced from the drum head whereby sound is not muffled when the drum head is struck.

When the muffle pillow is not in contact with the drum head as shown in FIG. 4, sound is not muffled when the drum head is struck by spur 18.

In the modified form of the invention shown in FIGS. 5–8 a bass drum 110 of standard construction includes the usual open-ended tubular shell 112 having its ends closed by skin-like drum heads 114 and 116 whereby a booming sound is produced when the drum heads are struck by such as a pedal actuated spur, not shown.

Means is provided for muffling such booming sound and includes an ovoid, approximately rectangular muffle pillow 130 disposed interiorly of drum 110 and fixed to the forward face of a complemental, vertically disposed, horizontally extending muffle plate 132 of like configuration as by a plurality of snap fasteners 134 provided along the periphery of the rear face of the muffle pillow and engageable with a plurality of aligned snap receptacles 136 provided along the periphery of the forward face of the muffle plate.

The rear face of muffle plate 132 is fixed by similar snap fasteners, not shown, to snap receptacles 133 on the forward face of a mounting plate 122.

A pair of spaced, vertically oriented hanger bars 124 are secured to the forward face of mounting plate 122 as by brackets 125 and are fixed at their lower ends to a rod-like cross bar 126 disposed below the muffle plate which extends horizontally across the diameter of shell 112 and is journalled at its opposite ends in openings 128 provided in the shell's lower quadrant.

Figure 6:
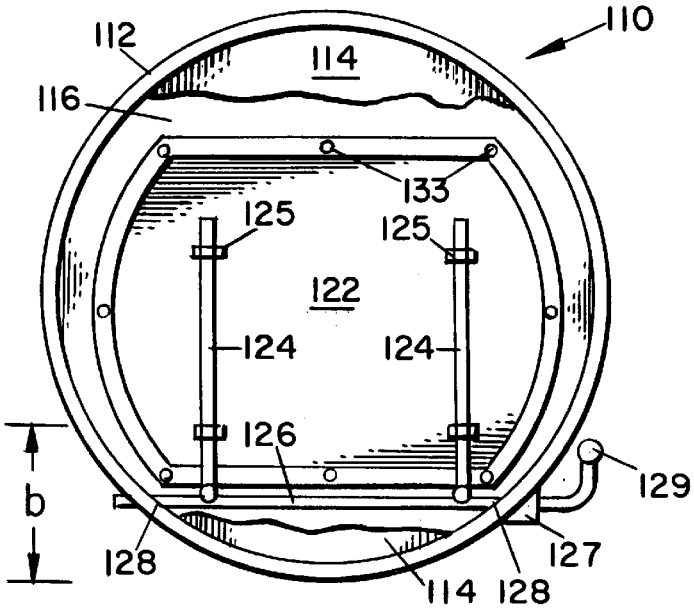
FIG. 6 is a front elevational view of the bass drum of FIG. 5 with the pillow muffle removed.
Figure 8:
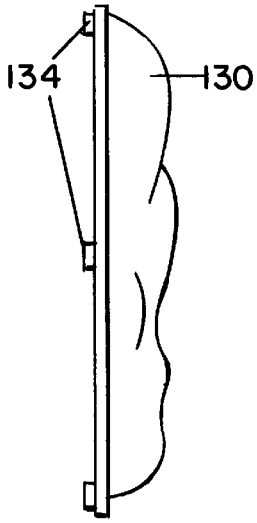
FIG. 8 is a side elevational view of the pillow muffle of FIG. 6.

One end of cross bar 126 extends outwardly from shell 112 through a bracket 127 attached to the outer periphery of the shell at one of the openings 128 with the free end of the cross bar being bent upwardly to provide a lever handle 129 which is disposed outwardly of the drum's exterior surface in the drum's lower quadrant, as indicated by b in FIG. 6, so as to be readily grasped by the drummer's hand, or alternatively, easily depressed by the drummer's foot.

By grasping or depressing the handle, it may be moved forwardly and rearwardly to cause cross bar 126 to pivot relative to shell 112 and bracket 127 thereby effecting swinging movement of mounting plate 122 to move muffle pillow 130 into and out of contact with the adjacent drum head 114.

When the muffle pillow is in contact with the drum head sound is muffled when the drum head is struck by the spur.

When the muffle pillow is not in contact with the drum head, sound is not muffled when the drum head is struck by the spur.

With the embodiment of FIGS. 1–4, or the embodiment of FIGS. 5–8, means is provided for muffling or dampening sound which is a permanent and integral part of the bass drum and which may be readily actuated at the drummer's discretion to produce the desired muffling or dampening effect.

In both embodiments, a handle is provided exteriorly of the bass drum which may be easily activated by the drummer to move a pillow muffle disposed interiorly of the bass drum into and out of engagement with one of the drum heads to achieve the desired muffling or non-muffling effects.

I claim:

1. A drum muffle in combination with a bass drum having a cylindrical shell with spaced open ends and drum heads extending across and closing said open ends, a pillow muffle disposed interiorly of the shell comprising, an ovoid, approximately rectangular muffle pillow fixed to the forward face of a complemental, vertically disposed, horizontally-extending muffle plate of like configuration, means mounting the pillow muffle for free swinging movement relative to the shell comprising, a pair of spaced, vertically oriented hanger bars secured to the forward face of the mounting plate, the hanger bars being fixed at one end to a rod-like cross bar which extends horizontally across the shell and is journalled at its opposite ends in openings provided in the shell, and activating means operatively connected to the pillow muffle for effecting free swinging movement of the pillow muffle into and out of contact with one of the drum heads when actuated by a drummer for selectively muffling or dampening sound when the drum head is struck, the activating means being a lever attached to the cross bar and extending through and movable relative to the shell, the lever having a handle disposed exteriorly of the shell adapted to be grasped by a drummer for selectively moving the pillow muffle.

2. A drum muffle in combination with a base drum according to claim 1, wherein the cross bar is located above the muffle plate.

3. A drum muffle in combination with a bass drum according to claim 1, wherein the cross bar is located below the muffle plate.

4. A drum muffle in combination with a bass drum according to claim 1, wherein the lever of the actuating means is spring-loaded and extends through a slot in the shell, the slot being provided with a locking offset.

5. A drum muffle in combination with a bass drum according to claim 1, wherein one end of the cross bar extends outwardly from the shell through a bracket attached to the outer periphery of the shell, and the lever of the actuating means is formed by bending the one end of the cross bar upwardly.

6. A drum muffle in combination with a bass drum according to claim 1, wherein the pillow muffle is fixed to the muffle plate by a plurality of snap fasteners.

* * * * *